United States Patent [19]

Koshiya

[11] 4,263,741

[45] Apr. 28, 1981

[54] ROLLER SKATING TOY

[75] Inventor: Yoshihiko Koshiya, Tokyo, Japan

[73] Assignee: Takara Co., Ltd., Tokyo, Japan

[21] Appl. No.: 79,336

[22] Filed: Sep. 27, 1979

[51] Int. Cl.[3] ..... A63H 11/00

[52] U.S. Cl. ..... 46/104; 46/103

[58] Field of Search ..... 46/104, 105, 107, 103

[56] References Cited

U.S. PATENT DOCUMENTS

| | | | |
|---|---|---|---|
| 630,850 | 8/1897 | Bowman | 46/104 |
| 1,261,528 | 4/1918 | Hess | 46/105 |
| 2,633,666 | 4/1953 | Levine | 46/105 |
| 2,641,864 | 6/1953 | Villemejene | 46/105 |
| 2,695,472 | 3/1954 | Ardolno | 46/105 |
| 3,128,575 | 4/1964 | Stanetzki | 46/105 |
| 4,051,623 | 10/1977 | Ogawa | 46/104 |
| 4,095,367 | 6/1978 | Ogawa | 46/104 |

*Primary Examiner*—Gene Mancene
*Assistant Examiner*—Michael J. Foycik, Jr.
*Attorney, Agent, or Firm*—Jackson, Jones & Price

[57] ABSTRACT

A toy figure configured in the shape of a person or animal and capable of effectively simulating a roller skating motion, is disclosed. The toy figure incorporates a chassis having a source of rotary motion such as a spring powered motor. A pair of substantially upright support members are mounted to the chassis and effectively simulate leg and foot portions of a person or of an animal. The support members are capable of a pendulum like oscillating motion relative to the chassis. A mechanism is operatively connected with the motor to move the support members in said oscillating motion.

Each support member incorporates at least one roller or wheel which is continuously driven by the motor through a suitable gear train and pulley and belt assembly or the like. The continuous rotation of the rollers or wheels and the simultaneous pendulum like oscillating motion of the support members propels the toy figure along a support surface in effective simulation of a roller skating or like motion.

15 Claims, 4 Drawing Figures

ROLLER SKATING TOY

BACKGROUND OF THE INVENTION

1. Field of the Invention

The present invention is directed to a self-propelling toy, and more particularly to a toy figure which is capable of moving along a support surface in a motion effectively simulating a roller skater and the like.

2. Brief Description of the Prior Art

Self-propelling toy dolls or toy figures which are capable of a simulated walking or running motion are well known in the toy manufacturing arts.

Generally speaking, walking toy dolls or toy figures of the prior art may be divided into three main types or categories depending on the type of mechanical arrangement which provides the simulated walking or running motion. Toys belonging to a first type have a pair of leg or foot type support members each of which is equipped with an endless belt or caterpillar tread in contact with a support surface. The endless belt or caterpillar tread is energized by a motor incorporated in the toy and propels the toy along a support surface. Toys described in U.S. Pat. Nos. 4,051,623; 3,648,408; and 3,587,191 are examples of walking toys of the first type.

In toys of a second type, a toy doll has two leg or foot type support members which incorporate rollers or wheels in contact with a support surface. The leg or foot type support members are driven by a motor to undergo a pendulum like oscillating motion resembling the walking motion of a person or animal. A clutch, or a ratchet and pawl assembly is operatively associated with the rollers or wheels so that each leg or foot type support member is prevented from sliding backwards on the support suface. Examples of toys of the second type are described in U.S. Pat. Nos. 3,128,575, 4,095,367, and 1,261,528.

Walking toys of a third type do not include wheels or rollers in the leg or foot simulating support members. In these toys, the leg or foot type support members are merely caused to undergo a pendulum like oscillating motion relative to the main body of the toy, with each leg or foot type support surface member alternatively coming into contact with the support surface. Such a toy is described for example in U.S. Pat. No. 3,564,763.

The pendulum-like oscillating motion of the leg or foot type support members in the hereinbefore generally described walking toys is brought about by application of well known mechanical devices. The devices include, crank wheels, crankpins, cam slots and crank levers which are driven by a suitable motor located in the toy.

U.S. Pat. No. 630,850 describes a toy doll said to be capable of simulating a skating motion. In this toy, wheels respectively mounted in the feet of the toy doll are permanently driven in a forward direction by a spring powered motor. A weight suspended in the toy figure for a pendulum like motion transverse to the direction of the forward motion of the toy figure, is driven by the same motor. As the weight oscillates sideways relative to the forward motion of the toy figure, the figure is said to oscillate sideways thereby simulating a skating motion.

In spite of the present availability of the several types of simulating walking toys, it is apparent that there is still a need in the toy designing arts for a toy doll or figure which is capable of effectively simulating a relatively rapid roller skating motion. In such a toy doll or figure, leg or foot simulating support members should faithfully simulate the roller skating motion of a person while the toy figure is moving rapidly forward on a support surface. The present invention provides such a toy figure.

SUMMARY OF THE INVENTION

It is an object of the present invention to provide a toy doll or figure which is capable of relatively faithfully simulating the roller skating motion of a person.

It is another object of the present invention to provide a mechanism driving a toy doll or figure in a simulated roller skating or like motion wherein leg and foot simulating support members oscillate relative to a main body of the toy doll or figure while rollers or wheels of the figure are continuously driven to propel the figure forward on a support surface.

These and other objects and advantages are attained by a toy doll or figure configured as a human being or as an animal. The toy doll or figure includes a chassis incorporating a source of rotary motion such as a spring powered motor. A pair of downwardly extending support members are mounted to the chassis so that each support member is capable of a pendulum like oscillating motion relative to the chassis. The support members are configured to simulate leg and foot portion of the toy doll and figure, and each support member includes at least one roller or wheel mounted for contact with a support surface.

The rollers or wheels are operatively and permanently connected to the motor so that the rollers or wheels are continuously driven by the motor when the toy doll or figure is in operation.

Each support member is also operatively and permanently connected to the motor so that the motor causes the pendulum like oscillating motion of each support member relative to the chassis. The combined effect of the oscillating support members and of the continuously driven rollers or wheels is that the toy figure propels itself along the support surface in faithful simulation of a roller skating motion.

The features of the present invention can be best understood together with further objects and advantages from the following description taken in connection with the accompanying drawings in which like numerals indicate like parts.

DESCRIPTION OF THE PREFERRED EMBODIMENTS

The following specification taken in conjunction with the drawings sets forth the preferred embodiments of the present invention in such a manner that any person skilled in the toy manufacturing arts can use the invention. The embodiments of the invention disclosed herein are the best modes contemplated by the inventor for carrying out his invention in a commercial environment, although it should be understood that various modifications can be accomplished within the parameters of the present invention.

Figure 2:
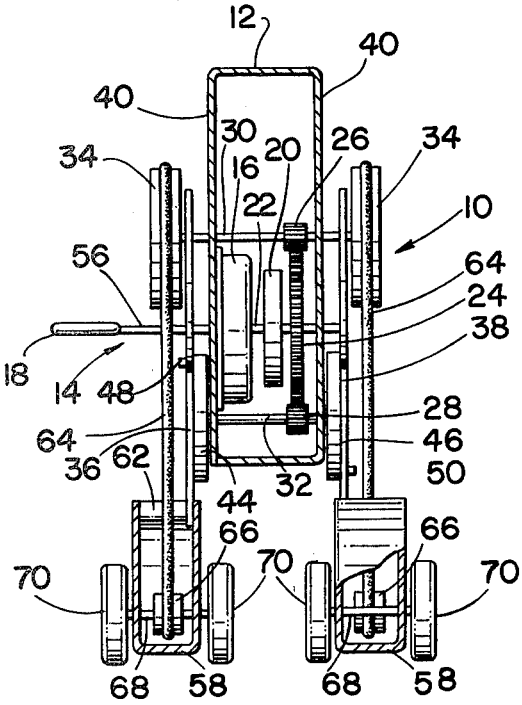
FIG. 2 is a view partly in cross section of a preferred embodiment of a drive mechanism of the present invention.

Referring now to the drawing figures and particularly to FIG. 2, a preferred embodiment of a driving mechanism 10 for the toy dolls or figures of the present invention is disclosed in detail.

Figure 1:
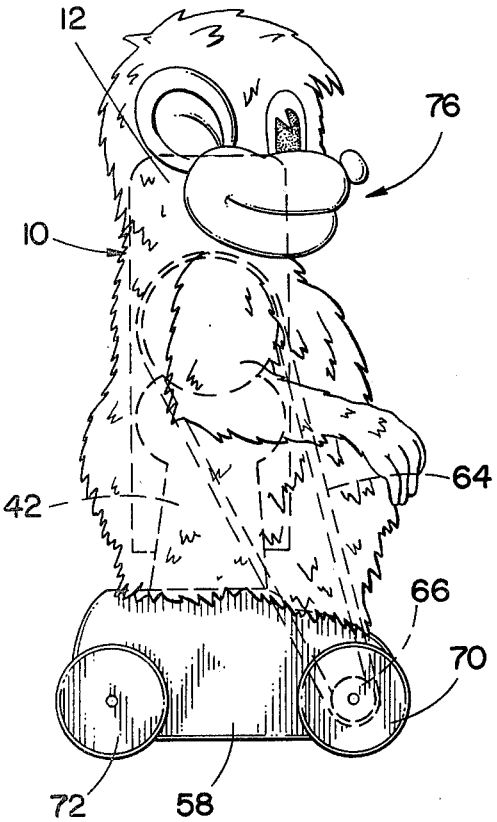
FIG. 1 is a schematic perspective view of a toy figure in the shape of an animal, the toy figure comprising a specific embodiment of the present invention.

The driving mechanism includes a chassis 12 which is incorporated into a toy doll or animal as is schematically shown in broken lines in the perspective view of FIG. 1. A suitable wind-up mechanism 14 having a spring powered motor is mounted within the chassis 12. Only an outside housing 16 of the spring powered motor is shown in FIG. 2. The wind-up mechanism 14 includes a wind-up lever 18 which protrudes from the chassis 12, and also from a body of a toy doll or figure.

A flywheel 20 is mounted upon an axle 22 protruding from the outside housing 16 of the motor. The purpose of the flywheel 20 is to ensure a smooth continuous operation of the toy while the mechanical energy stored in the wound-up spring (not shown) inside the housing 16, is released. It should be expressly understood that in alternative embodiments of the driving mechanism 10 of the present invention the spring powered motor may be replaced by an electric motor (not shown) powered by an appropriately located battery (not shown).

The axle 22 bearing the flywheel 20 also bears a first gear or cog-wheel 24 which is meshed with a second smaller gear 26 and with a third smaller gear 28. The second and third gears 26 and 28 are respectively located above and below the first gear 24 in chassis 12, and are mounted upon respective axles 30 and 32. As is shown on FIG. 2, the axle 30 of the second gear 26 and the axle 32 of the third gear 28 are parallel with the axle 22 of the first gear 24.

The axle 30 of the second smaller gear 26 protrudes a considerable distance in both directions from the chassis 12 and bears a pulley 34 on each side of the chassis 12. The pulleys 34 are fixedly mounted upon the axle 30 so that rotation of the axle 30 causes simultaneous rotation of the pulleys 34.

A plate is mounted upon the axle 30 between each pulley 34 and the chassis 12 on each side of the chassis 12. The plates respectively bear the reference numerals 36 and 38. The plates 36 and 38 extend in a downwardly direction substantially parallel with the adjacent side walls 40 of the chassis 12, as is shown on FIG. 2 and they comprise respective leg portions 42 of a toy animal or toy doll, as is schematically shown on FIGS. 1, 3 and 4. The plates 36 and 38 are suspended on the axle 30 in such a manner that each plate is able to undergo an oscillating or pivoting motion relative to the chassis 12 with the axle 30 acting as the pivot point.

Still referring to FIG. 2, a pair of crankwheels 44 and 46 are disclosed. One crankwheel is respectively positioned between the side wall 40 of the chassis 12 and the plates 36 and 38. The crankwheels 44 and 46 are fixedly mounted upon the axle 32 of the third gear 28 so that rotation of the third gear 28 causes simultaneous rotation of the crankwheels 44 and 46. Each crankwheel 44 and 46 bears a crankpin 48 and 50, and the crankpins 48 and 50 are accomodated and operatively positioned in substantially vertically disposed cam slots 52 and 54 respectively provided in the plates 36 and 38. Only the cam slot 54 is shown on the drawing Figures. The positioning of the crankpins 48 and 50 relative to one another is such that rotation of the crankwheels 44 and 46 causes pendulum like oscillation motion of the plates 36 and 38 in opposite directions relative to one another. The motion simulates the leg movements of a walking, running or skating person. A substantially horizontally disposed slot (not shown) is provided at least in the plate 36 to accomodate an axle 56 of the wind-up lever 18. The axle 56 remains stationary relative to the chassis 12 during the operation of the toy.

Figure 4:
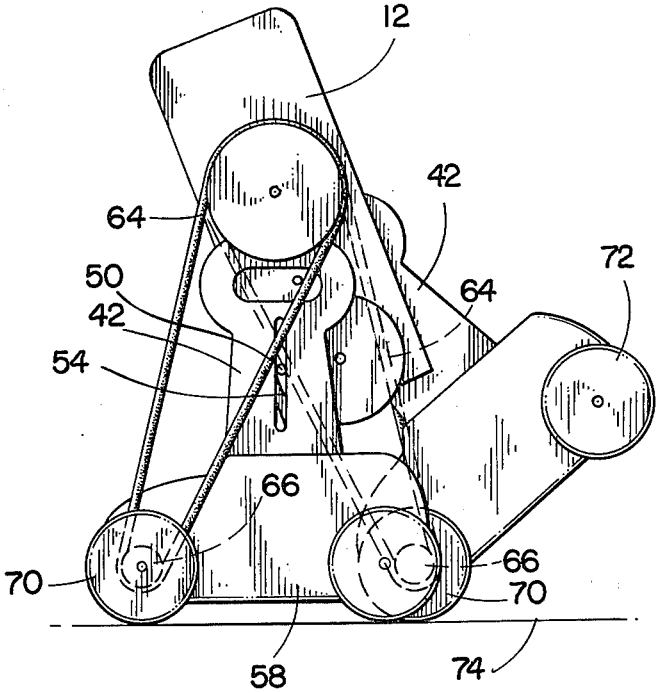
FIG. 4 is a schematic side view of a toy doll or figure of the present invention incorporating the drive mechanism, the view showing the toy doll in operation.
Figure 3:
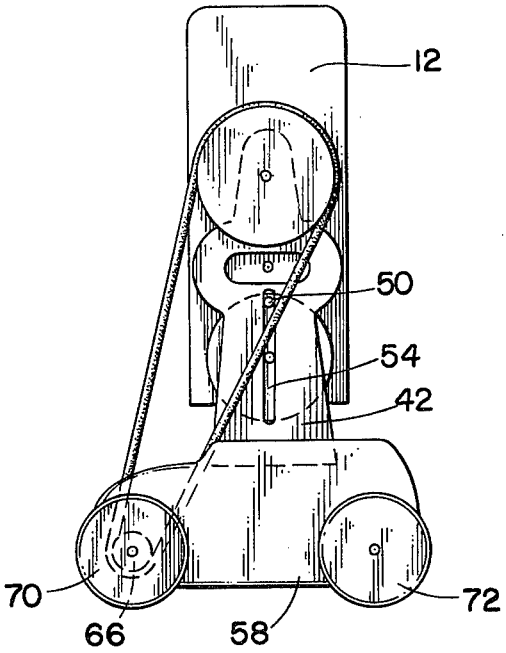
FIG. 3 is a schematic side view of a toy doll or figure of the present invention incorporating the drive mechanism.

Foot members 58 are attached to respective lower ends 60 of the plates 36 and 38. The foot members 58 have an opening 62 on their respective top portions to allow passage of an endless belt 64 which is mounted upon each of the pulleys 34. Another smaller pulley 66 is fixedly mounted to an axle 68 in each foot member 58. The endless belts 64 engage the smaller pulleys 66 so as to cause rotation of the smaller pulleys 66 and of the axles 68 whenever the mechanical energy stored in the spring powered motor is released. A first pair of rollers or wheels 70 is mounted to the axles 68 on the outside of each foot member 58 to rotate together with the axles 68. A second pair of idle rollers or wheels 72 are also mounted to each foot member 58, as is shown in FIGS. 1, 3 and 4. The positioning of the first driven pair of rollers 70 and of the second pair of idle rollers 72 is such that the driven rollers 70 are in a forward position relative to a direction of movement on a support surface 74 of the toy doll or figure. The support surface 74 is schematically shown on FIG. 4.

Having described the principal structural parts of the driving mechanism 10, the operation of the toy doll or toy figure in accordance with the present invention is explained below with principal reference to FIGS. 2 and 4.

As the spring powered motor rotates, the first gear 24 and pulleys 34 are set in rotary motion. The pulleys 34, in turn, rotate the first pair of rollers or wheels 70 on the foot member 58 through the action of the endless belts 64. The crankwheels 44 also rotate simultaneously with the rotation of the first pair of rollers 70 thereby causing oscillating motion of the plates 36 and 38 through the crankpin and vertical cam slot arrangement. Contact of the first pair of rollers 70 with the support surface 74 causes a forward motion of the toy doll.

As is shown on FIGS. 3 and 4, the chassis 12 of the toy is slightly inclined forward as is the torso of a running, skating or roller skating person. On FIG. 3 a toy figure of the present invention is schematically illustrated in a resting position.

When, as a result of the alternating oscillating motion of the plates 36 and 38, one leg portion or leg member 42 moves backward relative to the chassis 12, the rearwardly positioned idle rollers separate from the support surface 74. However, the forwardly positioned driven rollers 70 still remain in contact with the support surface 74. This situation is illustrated in the schematic view of FIG. 4. The alternate, oscillating motion of the leg portions or members 42 and the respective separation of the rear idle rollers 72 from the support surface 74 in the forwardly moving toy figure, very effectively simulates the roller skating motion of a person. Since the distance between the driving pulleys 34 and the driven smaller pulleys 66 does not vary as the leg members 42 oscillate, transmission of power to the first pair of rollers is efficient and smooth.

Referring now to FIG. 1, a specific embodiment of a toy figure 76 of the present invention is schematically illustrated. The toy figure 76 is in the shape of an animal or monster, and an outside decorative, stylized body of the toy figure 76 substantially hides the driving mechnism 10.

Various modifications of the present invention may become readily apparent to those skilled in the toy manufacturing arts in light of the herein disclosed generic principles. Particularly apparent modifications of the present invention include replacement of the endless belt drive with a cranklever type or like drive, and the shaping of a toy figure in several other configurations of animals or persons. In light of these and other readily apparent modifications, the present invention should be interpreted solely from the following claims.

What is claimed is:

1. A self propelling toy figure capable of simulating a roller skating motion and the like comprising:

a chassis;

a source of rotating motion incorporated into the chassis;

a pair of downwardly extending support members simulating a pair of legs of the toy figure, the support members being attached to the chassis so that each support member is capable of an oscillating motion relative to the chassis;

at least one rotating member mounted into each support member capable of being in contact with a support surface;

first means operatively connected to the source or rotating motion and to at least one rotating member in each support member for continuously driving the rotating members whenever the toy figure is in operation; and second means operatively connected to the source of rotating motion and to each support member for oscillating each support member relative to the chassis, the continuously moving rotating members propelling the toy figure forward on the support surface while the support members oscillate relative to the chassis whereby the toy figure effectively simulates a roller skating motion and the like.

2. The invention of claim 1 wherein the first means include a first pair of pulleys operatively connected to the source of rotating motion and a second pair of pulleys driving the rotating members, the first pair pulleys driving the second pair of pulleys through belts which are placed within the support members.

3. The invention of claim 2 wherein the two pulleys of the first pair are mounted to respective opposite sides on the outside of the chassis.

4. The invention of claim 1 wherein each support member includes a slot, and wherein the second means include a pair of crankwheels driven by the source of rotating motion, a crankpin being mounted on each crankwheel and engaging the slot whereby the support members are caused to undergo the oscillating motion.

5. The invention of claim 4 wherein each support member has two rotating members driven by the first means, and wherein each support member has two additional idle rotating members.

6. The invention of claim 1 wherein the source of rotating motion is a motor powered by a wound-up spring.

7. A toy figure capable of locomotion on a support surface effectively simulating a roller skater and the like, the toy figure comprising:

a chassis;

a motor incorporated in the chassis;

a pair of substantially upright positioned support members privotably mounted to sides of the chassis in a configuration simulating a pair of legs of a figure;

a first pair of pulleys, one pulley being rotatably mounted within each support member so that the axis of rotation of each pulley is substantially identical with the axis of pivot of the corresponding support member, the first pair of pulleys being operatively connected to the motor to be rotated thereby;

one pair of rollers mounted in each support member and being in contact with the support surface, the pair of rollers being continuously driven by the rotating motion of a respective pulley through a belt whenever the toy figure is in operation, and means connected to the motor for pivotably oscillating each support member relative to the chassis whereby the oscillating support members effectively simulate a roller skating motion and the like while the continuously rotating rollers propel the toy figure along a support surface.

8. The invention of claim 7 wherein the means for oscillating each support member include a crankwheel mounted to the side of the chassis betweeen the support member and the chassis, the crankwheel being rotated by the motor, the means further including a crankpin located on the crankwheel and accomodated in a slot provided in each support member.

9. The invention of claim 8 wherein a pair of idle rollers are also mounted in each support member.

10. The invention of claim 8 wherein the motor is powered by a wound-up spring.

11. The invention of claim 7 wherein the chassis is disposed in an inclined position relative to the vertical direction, the inclination of the chassis being in a forward direction relative to the motion of the toy on the support surface.

12. A self propelling toy figure simulating a roller skating motion and the like, the figure comprising:

a chassis;

a motor incorporated in the chassis;

a pair of downwardly extending support members simulating a pair of legs of the toy figure, the support members being attached to the chassis so that each support member is capable of a pivoting oscillating motion relative to the chasis;

at least a first rotating member mounted in each support member for being in permanent contact with a support surface during the roller skating motion of the toy figure;

at least a second rotating member mounted into each support member for being alternatively in contact with the support surface and being separated therefrom during the roller skating motion of the toy figure;

first means operatively connected to the motor and to the first rotating member in each support member for continuously driving the first rotating members whenever the toy figure is in operation, and second means operatively connected to the motor and to each support member for oscillating each support member relative to the chassis, the continuously moving first rotating members propelling the toy figure forward on the support surface while the support members oscillate relative to the chassis and the second rotating members roll idly when in contact with the support surface, whereby the toy figure effectively simulates a roller skating motion and the like.

13. The invention of claim 12 wherein the first means include a pulley and belt assembly.

14. The invention of claim 12 wherein the second means include two crankwheels, one crankwheel being mounted to a side of the chassis between the chassis and one support member, each support member has a slot, and each crankwheel has a crankpin operatively engaging a respective slot.

15. The invention of claim 12 wherein the chassis is disposed in an inclined position relative to the vertical direction, the inclination of the chassis being in a forward direction relative to the motion of the toy on the support surface.

* * * * *